United States Patent [19]

Akers

[11] 4,275,875

[45] Jun. 30, 1981

[54] MAIL SORTING MACHINE

[75] Inventor: Roy Akers, Lafayette County, Mo.

[73] Assignee: Bell & Howell Company, Chicago, Ill.

[21] Appl. No.: 973,926

[22] Filed: Dec. 28, 1978

[51] Int. Cl.[3] ..... B65H 3/12; B65H 31/06; B65H 31/24

[52] U.S. Cl. ..... 271/5; 271/94; 271/30 A; 271/214; 271/305

[58] Field of Search ..... 271/5, 4, 6, 94, 30 A, 271/150, 305, 303, 178, 177, 210, 214, 146, 279, 298, 297, 215; 209/584, 657, 656; 414/104, 51, 103, 107

[56] References Cited

U.S. PATENT DOCUMENTS

| | | | |
|---|---|---|---|
| 2,742,286 | 4/1956 | Williams et al. | 271/305 |
| 3,038,607 | 6/1962 | Eckert | 209/656 X |
| 3,162,438 | 12/1964 | Perry | 271/214 X |
| 3,260,520 | 7/1966 | Sugden | 271/94 |
| 3,285,389 | 11/1966 | Kaplan | 271/150 X |
| 3,386,574 | 6/1968 | Kaplan | 271/5 X |
| 3,735,976 | 5/1973 | Watson | 271/94 |

*Primary Examiner*—Bruce H. Stoner, Jr.
*Attorney, Agent, or Firm*—Lowe, Kokjer, Kircher, Wharton & Bowman

[57] ABSTRACT

The mail sorting machine of the present invention is capable of receiving a supply of envelopes in a magazine from which the individual envelopes are picked off in succession by means of a suction device operating in combination with a pair of conveying belts having a friction surface facing the incoming envelopes. The suction device acts through holes in the conveying belts to draw the lead envelope against the friction surface of the conveying belts for separation of this envelope from the rest of the supply. The separated envelope is then transferred to a read station where a reading device reads a sort code imprinted on the envelope. The envelope is then provided to the storage section of the machine where it is directed to its designated sorting bin. The storage section of the machine is provided with a plurality of diverter mechanisms which are arranged in pairs to form a guideway through which the envelopes are directed. As an envelope approaches its designated sorting bin, the diverter mechanism associated with this bin is activated. Activation of the diverter mechanism causes its deflector gate to be interposed within the guideway to direct the approaching envelope into the sorting bin associated with the deflector mechanism. Each sorting bin has a rib which runs along the floor of the bin to hold the envelopes in an offset position wherein the inherent vibratory motion of the machine causes the envelopes to be aligned in a neat stack. Each sorting bin is also equipped with a biasing plate which serves to keep the envelopes stored within the bin in a vertical plane.

4 Claims, 12 Drawing Figures

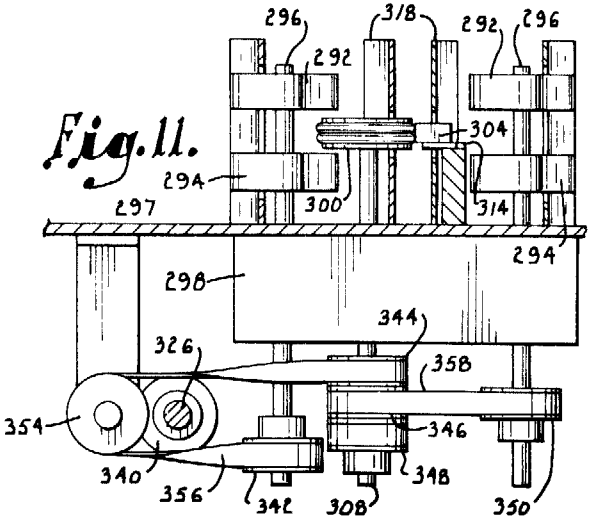
Fig. 11.
Fig. 10.
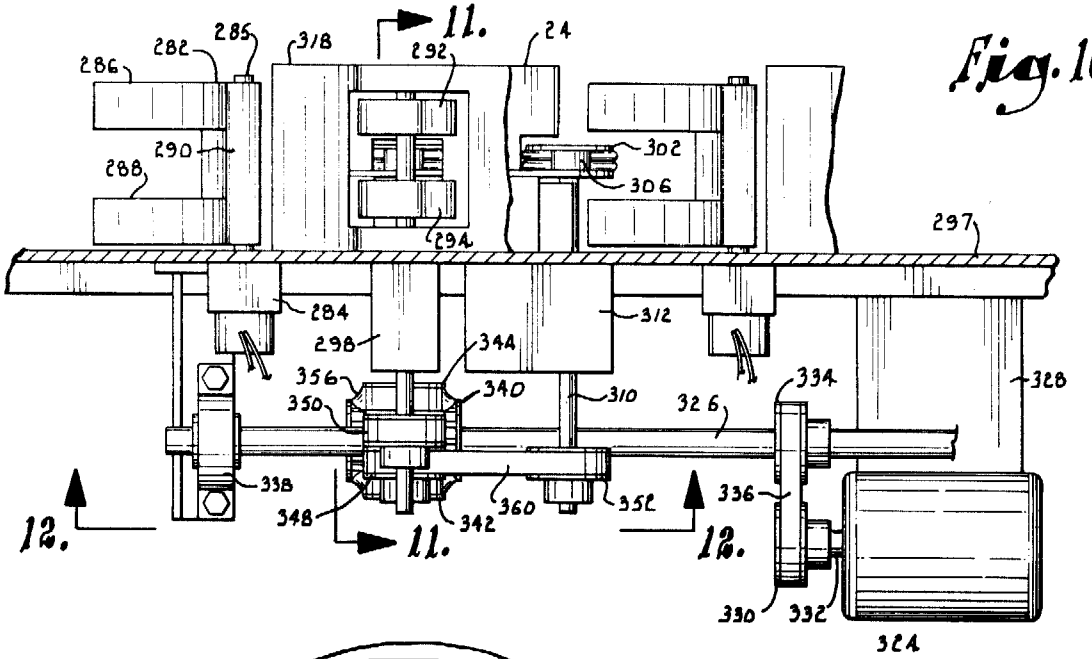
Fig. 12.
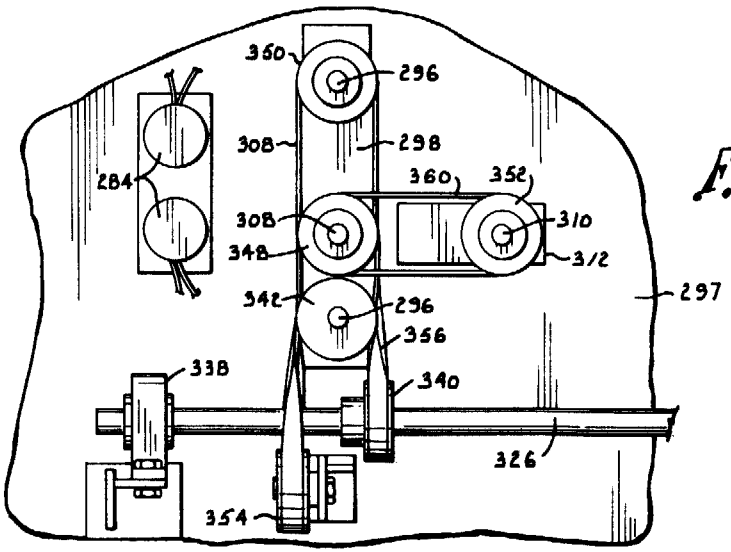

MAIL SORTING MACHINE

BACKGROUND AND BRIEF DESCRIPTION OF THE INVENTION

This invention relates in general to the handling of mail and, in particular, to an improved mail sorting machine.

The volume of mail handled daily by large businesses, institutions and governmental entities has steadily increased through the years. For example, credit card companies, utilities, mail order houses and other advertisers send and receive huge quantities of mail daily. Typically, the envelopes containing the material to be mailed are addressed and then sorted into common groups for mailing. Similarly, the mail received by such entities is commonly sorted into groups based on the subject matter of the received material. The quantity of mail handled daily by large businesses, institutions and governmental entitites has reached the point where new techniques and machines for automatically handling and sorting the incoming and/or outgoing mail more efficiently and economically must be developed.

Although several machines have been developed to assist in the handling and sorting of mail, such equipment has not proved to be satisfactory for several reasons. In particular, existing mail sorting machines are very complex in design and operation and require a large amount of space. Such machines are also costly to purchase and maintain. In addition, these machines are not very reliable and tend to fold, crumble, tear or otherwise damage the envelopes they handle. Another problem associated with prior art mail sorting machines is that they often fail to properly separate consecutive envelopes. As a result, two envelopes may be conveyed through the machine together and improperly deposited in the same sorting bin. Existing sorting machines also have the tendency to direct an envelope to the wrong bin.

A general solution of these prior art difficulties is given and described in the commonly owned U.S. patent application entitled MAIL SORTING MACHINE which was filed by Roy Akers, on Apr. 6, 1978, and given Ser. No. 900,070, now abandoned. That patent application is incorporated herein by reference for the purpose of illustrating the state of the prior art. While the mail sorting machine disclosed in that patent application represents a significant advance over the prior art, the design and operation of that machine is still fairly complex. The mail sorting machine described in the previously filed Akers patent application utilizes an array of metal bands which form a plurality of guideways for transferring the separated envelopes to their designated sorting bins. This type of transfer system requires the use of a complex sorting mechanism for introducing an envelope into its appropriate guideway.

It is therefore an object of the present invention to provide a mail sorting machine which is not only extremely reliable but also simple and economical to construct and operate.

Another object of the present invention is to provide a mail sorting machine of the character described which is capable of separating successive envelopes in a simple and effective manner. The mail sorting machine of the present invention includes an extremely reliable feed station for effectively separating the incoming stack of envelopes for sorting. A stack of envelopes is initially deposited on a magazine which conveys the envelopes toward the feed station. This feed station is comprised of a suction device which operates in conjunction with a pair of conveying belts to effectively draw the lead envelope away from the remainder of the supply and to keep this envelope in contact with the conveying belts for transfer to the rest of the sorting equipment. The suction device is comprised of a hollow box having two rectangular suction openings cut therein and a suction pump for maintaining a low pressure within the box. The suction box is located in close proximity to the incoming envelopes so that a portion of each suction opening overlaps at least a portion of the flat surface of the leading envelope. The conveying belts, on the other hand, are positioned to revolve in unison around the suction box in a direction which is perpendicular to the direction in which the letters are being advanced. Each conveying belt is positioned over a different suction opening and each belt is periodically provided with a grouping of holes with each grouping of holes in each belt being similarly positioned so that whenever a grouping of holes on one belt is positioned between its corresponding suction opening and the leading envelope, a corresponding grouping of holes on the other belt is similarly positioned. Whenever a series of these holes are positioned between its corresponding suction opening and the leading envelope, the low pressure within the box acts through this series of holes to draw the leading envelope toward the conveying belt for transfer away from the remaining stack of envelopes. By concentrating the suction force to such a limited area, the problem of vacuum bleed through is eliminated thereby facilitating separation of the envelopes by preventing the suction device from simultaneously drawing two envelopes toward the conveying belt. To further facilitate separation of the envelopes, the present invention includes a pair of jogger arms which serve to force the entire stack of mail away from the conveying belt just before the lead envelope is drawn toward the belt by the suction device. The effective result of this operation is to further reduce the tendency of the machine to simultaneously pick two separate envelopes.

Another object of the present invention is to provide a mail sorting machine of the character described which is capable of handling heavier mail due to the positive action between the conveying belts and the lead envelope which is drawn toward the belts by the suction device.

It is an additional object of the present invention to provide a mail sorting machine of the character described which utilizes a simple technique for directing an envelope to the appropriate sorting bin. Each sorting bin is provided with a unique diverter mechanism which is operable to deflect an envelope into its associated sorting bin in response to an appropriate control signal. The diverter mechanism is comprised of a deflecting gate having a wing portion protruding outward therefrom and a solenoid for controlling the position of the deflecting gate. The diverter mechanisms are arranged in pairs so that the wing portion of the deflecting gate of each mechanism form a channel through which the mail is capable of being conveyed in a vertical orientation. Each diverter mechanism responds to an appropriate control signal by moving its deflector gate to deflect the next envelope which is being conveyed through the channel formed by the diverter mechanism into the sorting bin associated with the activated diverter mechanism.

A further object of the present invention is to provide a mail sorting machine of the character described which includes a plurality of sorting bins having a unique construction which allows them to make use of the machines inherent vibratory motion to properly align the mail within each sorting bin.

Yet another object of the present invention is to provide a mail sorting machine of the character described which is simple to operate and which can be quickly and easily programmed to deliver envelopes to various selected bins.

It is yet another object of the present invention to provide a mail sorting machine of the character described wherein the envelopes are conveyed and handled in a reliable manner without being subject to folding, tearing or other damage.

Other and further objects of this invention, together with features of novelty apurtenant thereto, will appear in the course of the following description.

DETAILED DESCRIPTION OF THE INVENTION

In the accompanying drawings which form a part of the specification and are to be read in conjunction therewith and in which like reference numerals are employed to indicate like parts in the various views:

FIG. 10 is a fragmentary sectional view on an enlarged scale taken along line 10—10 of FIG. 3 in the direction of the arrows;

FIG. 11 is a fragmentary sectional view taken along line 11—11 of FIG. 10 in the direction of the arrows; and FIG. 12 is a fragmentary bottom plan view taken generally along line 12—12 of FIG. 10 in the direction of the arrows.

Figure 1:
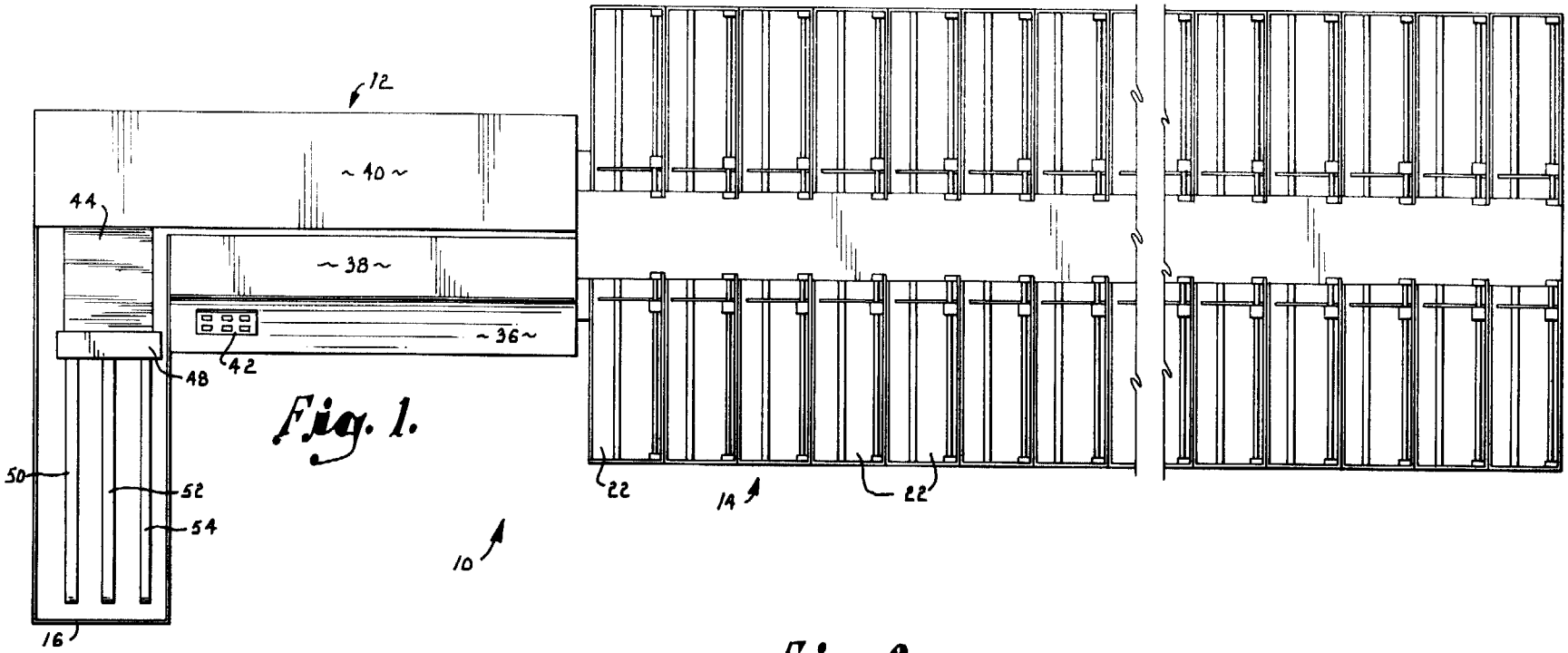
FIG. 1 is a top plan view of a mail sorting machine constructed according to a preferred embodiment of the present invention, with the broken away portions indicating continuous length.
Figure 2:
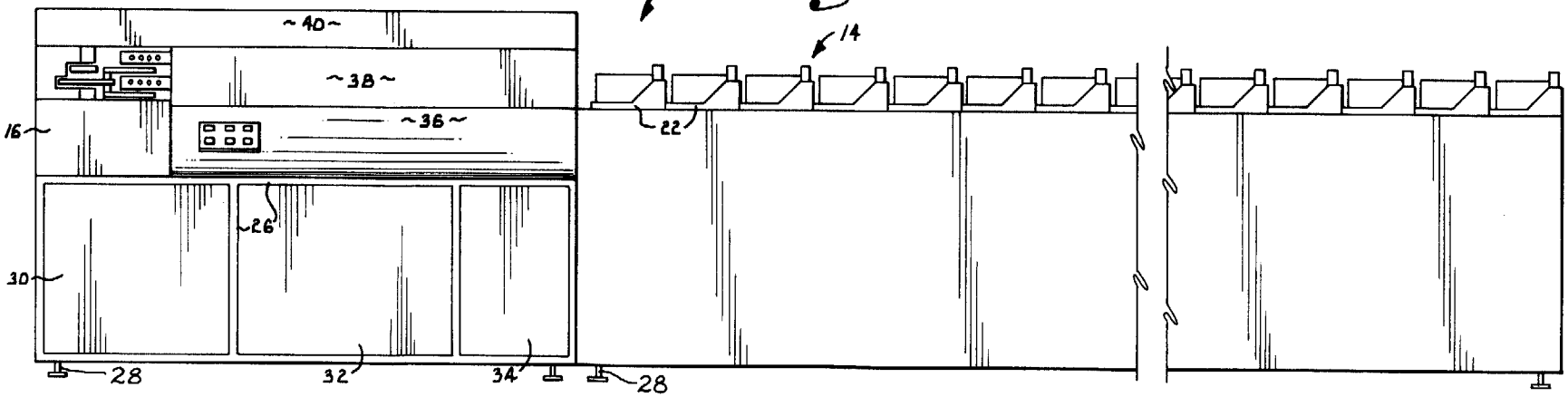
FIG. 2 is a side elevational view of the mail sorting machine shown in FIG. 1, with the broken away portions indicating continuous length.
Figure 3:
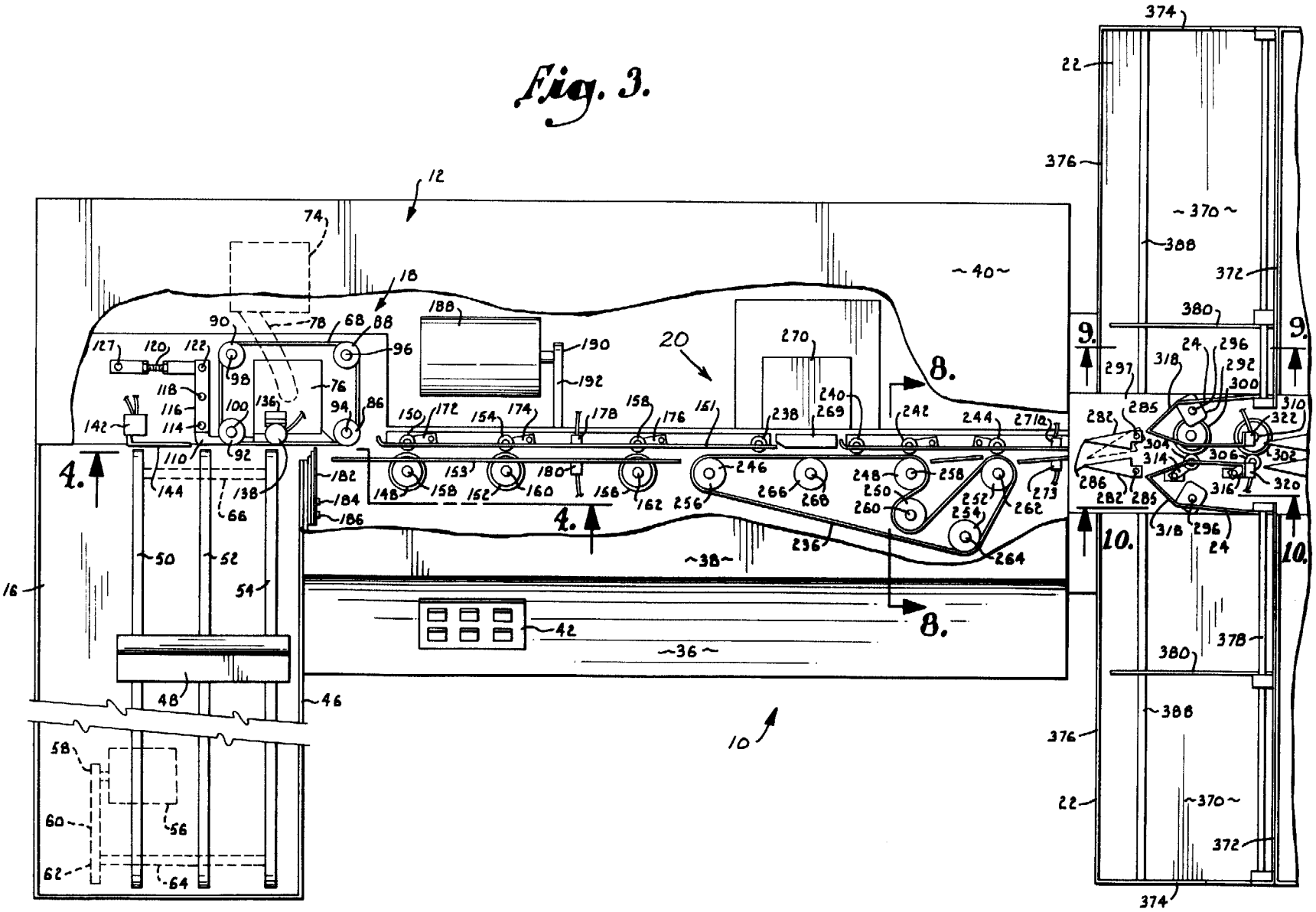
FIG. 3 is an enlarged, fragmentary top plan view of the mail sorting machine, with portions broken away for purposes of illustration.

Reference is now made to the drawings in detail and initially to FIGS. 1, 2 and 3 wherein the numeral 10 is used to designate a mail sorting machine which is constructed in accordance with a preferred embodiment of the present invention. This mail sorting machine includes an input station which is generally designated by the numeral 12 and a storage section which is generally designated by the numeral 14. The input section of the machine is comprised of a magazine 16 for receiving the mail to be stored, a feed station 18 for separating incoming mail, and a read station 20 for reading a sort code imprinted on each envelope. The storage section, on the other hand, includes a plurality of sorting bins 22 for receiving and storing envelopes. Each sorting bin is provided with an associated diverter mechanism for directing an envelope into its associated bin in response to a activation signal from the machine's control circuitry.

The input section of the machine is constructed of a structural frame 26 which is supported by a plurality of legs 28 having feet which rest on the floor or other support surface. A plurality of panels, 30, 32, 34, 36, 38 and 40 are provided to enclose the operating components of the machine. In addition, a control panel 42 having a plurality of operative switches is mounted onto panel 36.

Magazine 16 is mounted to the structural frame to extend forwardly to the input station as best shown in FIGS. 1 and 3. Magazine 16 presents a flat horizontal surface for receiving a supply of envelopes 44 which are to be sorted by the machine. The envelopes are placed on the magazine with the large flat front and back surfaces of the envelopes disposed against one another and with each envelope occupying a substantially vertical plane. The envelopes are positioned on the magazine so that the front surface of each envelope faces toward the feed station and the longer edges of the envelopes rest on the upper surface of the magazine. Magazine 16 is also provided with a lateral ridge 46 which protrudes upward from the flat surface of the magazine to provide a guide for aligning the envelopes. When properly aligned, the short edge of the envelopes is in contact with this ridge to ensure that the envelopes are properly positioned with respect to the feed station.

It is possible to use a carriage 48 in the form of a block to ride on the top of three parallel rubber belts (or chains) 50, 52 and 54 to advance the envelopes along the magazine toward the feed station of the device. However, the preferred embodiment does not require the block. These belts are spaced apart from one another and are driven by an electric motor 56 in a direction which the upper surface of the belts are moving forwardly along the top surface of the magazine thereby moving the carriage 48 and envelopes 44 toward the feed station of the machine. Motor 56 drives a pulley 58 which receives a belt 60. This belt is passed around another pulley 62 which is carried on a horizontal shaft 64. Shaft 64 carries pulleys (not shown) which receive the drive belts 50, 52 and 54. The forward end of each belt is passed around additional pulleys (not shown) which are carried on an idler shaft 66 mounted near the forward end of the magazine. The carriage 48 may be lifted off the belts and moved rearwardly to accommodate an additional supply of envelopes deposited behind those already located on the magazine.

Figure 4:
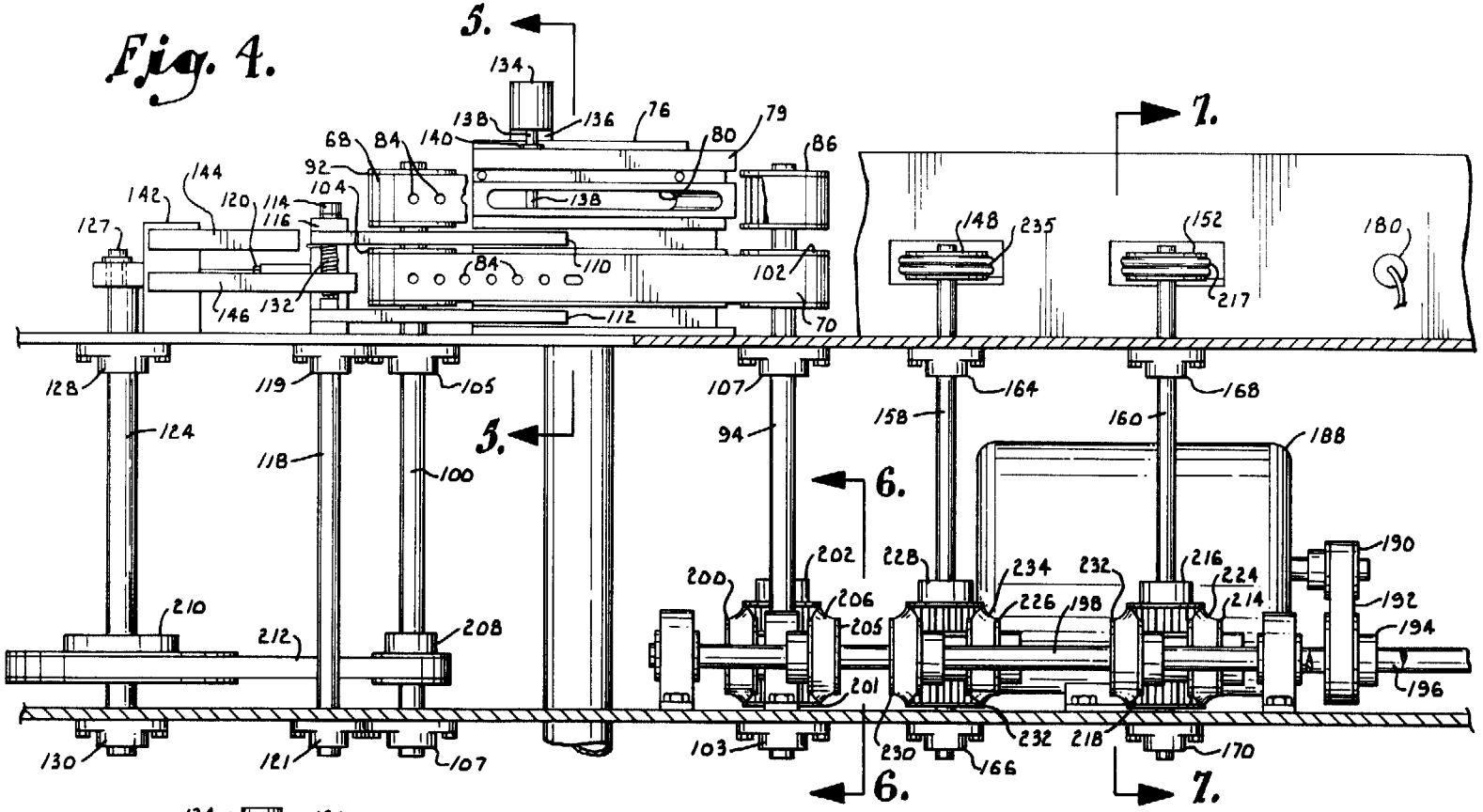
FIG. 4 is a fragmentary diagrammatic view taken generally along line 4—4 of FIG. 3 in the direction of the arrows.
Figure 5:
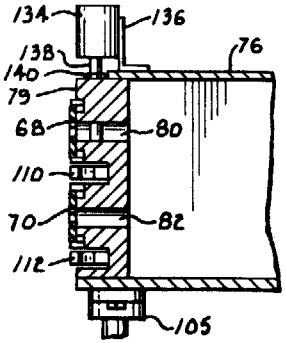
FIG. 5 is a sectional view taken along line 5—5 of FIG. 4 in the direction of the arrows.

Referring now to FIGS. 3, 4 and 5 in particular, carriage 48 advances the envelope supply along magazines 16 to bring the leading envelope into position at feed station 18. The feed station is equipped with a pair of conveying belts 68 and 70 which cooperate with a suction device 72 to pick off the leading envelope and convey it away from the feed station to the read station. Suction device 72 is comprised of a vacuum pump 74 and a hollow suction box 76 which is mounted on the frame at the feed station in proximity to the incoming envelope supply. The vacuum pump is coupled with the suction box by means of a hose 78 and is operable to maintain a low pressure within the box.

The suction box is provided with a base plate 79 which has a pair of suction openings 80 and 82 defined therein. These suction openings are positioned to face the incoming envelope supply and are oriented so that at least a portion of each opening overlaps the front flat surface of the leading envelope.

Each conveying belt is periodically provided with a grouping of holes which are represented by the numeral 84. Each grouping of holes on each of the conveying belts is similarly positioned so that the holes in each belt are correspondingly aligned with each other as shown in FIG. 4. Conveying belt 68 is drawn tightly around pulleys 86, 88, 90 and 92 which are mounted on vertical shafts 94, 96, 98 and 100 respectively. Conveying belt 70, on the other hand, is mounted in parallel with belt 68 by means of four pulleys which are also mounted on shafts 94, 96, 98 and 100. Two of these pulleys are shown in FIG. 4 and are identified by the numerals 102 and 104. These two pulleys are mounted on shafts 94 and 100 respectively. Vertical shafts 94, 96, 98 and 100 are rotatably mounted to the frame of the machine by means of flange bearings such as 101, 103, 105 and 107.

The conveying belts are wider than the suction openings 80 and 82 and are positioned over the openings to present a friction surface to the leading envelope of the incoming stack of mail. Shaft 94 acts as a drive shaft which drives both of these conveying belts in a counterclockwise direction as viewed in FIG. 3. In this way, the conveying belts present a friction surface to the incoming stack of mail which is moving in a direction that is perpendicular to the direction in which the envelope stack is being advanced or from left to right when viewed in FIG. 4.

A pair of jogger arms 110 and 112 are provided to further facilitate separation of the envelopes. Both jogger arms are fixedly secured to a common shaft 114 which is pivotally mounted between the protruding arms of a pivot bar 116. Pivot bar 116 is in turn pivotally coupled with the frame by means of a vertical shaft 118. In particular, the pivot bar is fixedly secured to the shaft 118 which is in turn rotatably coupled to the frame of the mail sorting machine by means of flange bearings 119 and 121. A bell crank arm 120 is pivotally coupled with the pivot bar by means of a pivot pin 122 to impart movement to the pivot bar about its pivot point 118. The other end of the bell crank arm is rotatably coupled with a drive shaft 124 in an eccentric manner by means of a pin 127. This drive shaft is rotatable coupled with the frame by means of a pair of flange bearings 128 and 130. By eccentrically coupling the bell crank arm 120 to drive shaft 124, rotatable movement of this shaft causes the pivot bar 116 to continuously pivot about shaft 118. This pivotal movement of the pivot bar in turn causes the jogger arms to oscillate between a retracted position wherein each jogger arm sits within a corresponding groove defined in face plate 79 behind the friction surface of the conveying belts and an extended position whenever the jogger arms protrude outward from the conveying belts to push the entire stack of mail back away from the friction surface of each conveying belt.

A coiled spring 132 is used to maintain the jogger arms in a pushing position with respect to the pivot bar. In this pushing position, the jogger arms are capable of limited pivotal movement in a clockwise direction when viewed in FIG. 3. Pivotal movement of the jogger arms in a counterclockwise direction (when viewed in FIG. 3), however, is prevented by the physical configuration of the pivot bar and jogger arms. Pivotal movement of the jogger arms in a clockwise direction (as viewed in FIG. 3) increases the tension of the coiled spring 132 which in turn produces a force which tends to return the jogger arms to the pushing position. In this way, the jogger arms are capable of effectively pushing the entire stack of mail back away from the conveying belts while still being capable of limited pivotal movement in a clockwise direction (as viewed in FIG. 3).

As a safety feature, a solenoid 134 is mounted to the top suction box 76 by means of an L-shaped bracket 136. The plunger of this solenoid has a metal shaft 138 physically coupled to it. This metal shaft is positioned to move within a hole defined in face plate 79. A bushing 140 is provided within this hole to facilitate movement of the shaft therethrough. Activation of the solenoid causes its plunger to be retracted thereby raising shaft 138. When shaft 138 is in this position, the jogger arms are free to enter and sit within their corresponding grooves in the face plate behind the friction surface of the conveying belts. Deactivation of this solenoid, however, causes metal shaft 138 to drop to a position behind jogger arm 112 wherein it prevents this jogger arm from entering its corresponding groove. As a result, the jogger arms are maintained in an extended position wherein they protrude outward from the friction surface of the conveying belts to keep the lead envelope from coming in contact with these belts. In this way, the solenoid and jogger arms act as an automatic shutoff which prevents further separation of envelopes upon deactivation of this solenoid.

A switch 142 having a pair of contact arms 144 and 146 is provided to control the operation of the motor 56 which advances carriage 16. The contact arms of the switch are hingedly secured to the switch and are used to control the condition thereof. The switch is provided with two contact arms to accomodate various orientations of the incoming stack of mail. The switch is located and oriented such that the incoming envelopes are capable of contacting and moving the contact arms of the switch to an "off" position whenever an envelope is properly positioned at the feed station. When the contact arms are in an "off" position, the switch mechanism is maintained in an "off" condition and motor 56 remains de-energized. However, when enough envelopes have been picked off the front of the stack so that there is no envelope in position at the feed station, the contact arms are returned to an "on" position which in turn causes motor 56 to be energized. In this way, carriage 16 is intermittently advanced forwardly to locate the leading envelope at the feed station in the proper position to be picked off by the suction device and conveying belts.

The conveying belts contact the front surface of the leading envelope to feed this envelope to a pinch wheel assembly which is comprised of pinch rollers 148 and 150. This pinch wheel assembly operates in combination with two additional pinch wheel assemblies comprised of pinch rollers 152, 154, 156 and 158 to convey the envelopes to the read station in a direction parallel with their length dimension in a vertical position. A pair of guide plates 151 and 153 are mounted to the frame to provide a guideway through which the mail may be conveniently transferred. Rollers 148, 152 and 156 are respectively mounted on vertical shafts 158, 160 and 162 and are driven in a manner that will be explained more fully hereinafter. As shown in FIG. 4, vertical shaft 158 is rotatably coupled with the device's frame by means of flange bearings 164 and 166. Vertical shaft 160, on the other hand, is similarly coupled with the frame by means of flange bearings 168 and 170. Rollers 150, 154 and 156, on the other hand, are appropriately coupled with the frame by means of brackets 172, 174 and 176 respectively.

A photosensor 178 and light source 180 are used to monitor the operation of the mail sorting device. The photosensor and light source are located and oriented such that an envelope moving toward the read station intercepts the light beam projected between them. Upon interception of the light beam, the photosensor generates an electrical signal which is used by the control circuitry to monitor the progress of the envelope and to alert the reading device that an envelope is approaching.

A forwardly projecting finger 182 is appropriately located between the feed station and the pinch wheel assembly comprised of rollers 148 and 150 to pick off any envelopes that may stick to the back side of the leading envelope. This finger is comprised of a plurality of leaf springs which are secured to each other and to the device's frame by means of nut and bolt assemblies 184 and 186.

With reference to FIGS. 3, 4, 6 and 7, the various drive components of the feed station are driven by an electric motor 188 which drives an associated pulley 190. A belt 192 is passed around pulley 190 and around a second pulley 194 which is mounted on a horizontal shaft 196. This shaft is rotatably supported on the frame of the machine and operates in combination with a horizontal idler shaft 198 and numerous pulleys to transfer the motion imparted to this shaft by the motor to the various drive components of the feed station.

Figure 6:
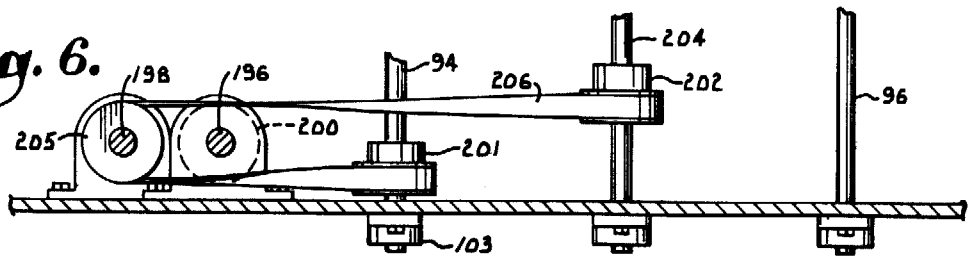
FIG. 6 is a fragmentary sectional view taken along line 6—6 of FIG. 4 in the direction of the arrows.

Referring now principally to FIGS. 4 and 6, a pulley 200 which is carried by shaft 196 operates in combination with a pulley 201 which is carried by vertical shaft 94, a pulley 202 which is mounted on an idler shaft 204 and a pulley 205 which is carried by idler shaft 198 to drive the conveying belts 68 and 70 of the feed station. Rotatable movement is imparted to shaft 94 from horizontal shaft 196 by means of a belt 206 which passes around pulley 200 before being twisted and passed around pulley 201. The belt is twisted again and passed around the vertical idler pulley 205. The belt is then twisted one more time and drawn around idler pulley 202 before being twisted a final time and passed back around pulley 200. The rotatable movement thus imparted to drive shaft 94 is in turn transferred to conveying belt 68 and 70 by means of pulleys 86 and 102 respectively.

The conveying belts are also used in driving the jogger arms. As shown in FIG. 4, the rotatable movement imparted to drive shaft 94 is transferred to drive shaft 100 by the conveying belts which cause shaft 100 to rotate in unison with drive shaft 94. The rotatable movement imparted to shaft 100 is in turn transferred to drive shaft 124 by means of a pulley 208 which is mounted to shaft 100, a pulley 210 which is mounted to shaft 124 and a belt 212 which is drawn around both of these pulleys. As shaft 124 rotates, the bell crank arm 120 causes the pivot bar 116 to pivot about its pivot point due to the eccentric manner in which the bell crank arm is coupled to shaft 124. This pivotal movement of the pivot bar is in turn imparted to the jogger arms to cause the arms to oscillate between the retracted and extended positions.

Figure 7:
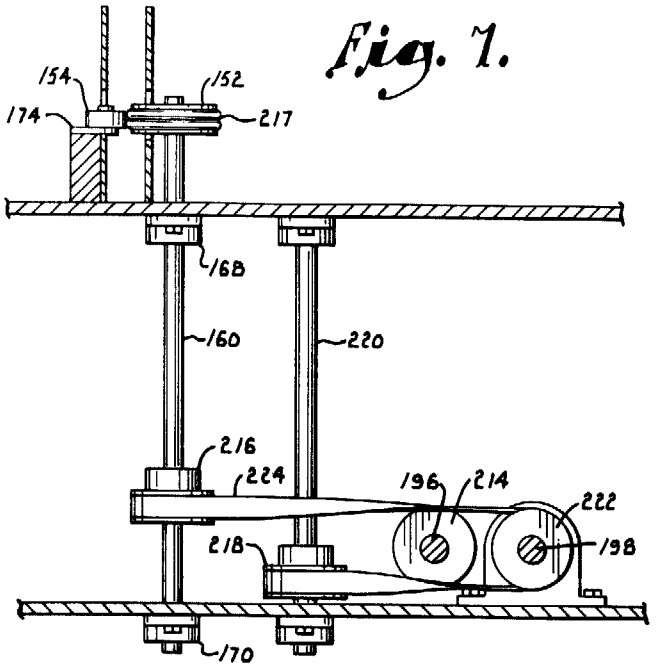
FIG. 7 is a cross sectional view on an enlarged scale taken along line 7—7 of FIG. 4 in the direction of the arrows.

Referring now particularly to FIGS. 4 and 7, drive rollers 148, 152 and 156 are all driven by the electric motor 188 via horizontal shaft 196. Shaft 196 carries a plurality of pulleys such as 214 which are spaced apart along the length of the shaft at locations which correspond with the various drive rollers. Pulley 214 imparts rotational movement to the roller's drive shaft 160 by means of a belt 224 which passes around pulley 214. The belt is then twisted and passed around a pulley 216 which is mounted to drive shaft 160. From pulley 216, the belt is twisted again and passed around a vertical idler pulley 222 which is mounted on idler shaft 198. The belt is then twisted one more time and passes around another idler pulley 218 which is mounted on an idler shaft 220 before being twisted a final time and passed back around pulley 214. As shown in FIG. 7, roller 152 is provided with a friction surface 217 comprising a rubber O-ring which encircles the outer circumference of this roller. The opposing pinch roller 154, on the other hand, is simply an idler roller which is appropriately mounted to the frame of the machine by means of a bracket 174 and is biased toward the friction surface of roller 152. Roller 148 is similarly driven off of shaft 196 by means of pulleys 226, 228, 230 and 232 and belt 234. Its opposing pinch roller 150 is likewise an idler roller which is appropriately mounted to the frame of the machine and biased toward the friction surface of roller 148. Roller 148 also has a rubber O-ring 235 encircling this roller to provide an increased coefficient of friction between this roller and the envelope. While not shown in detail, roller 156 is driven off of horizontal shaft 196 in a similar manner and its associated pinch roller is mounted to the frame of the machine as described above.

Reference is now made to FIG. 3 for a more detailed description of the read station 20 of the mail sorting device. The envelopes are driven through the read station by means of a belt 236 which operates in combination with a plurality of idler rollers 238, 240, 242 and 244. Belt 236 is tightly drawn around a plurality of pulleys 246, 248, 250, 252 and 254 which are mounted on shafts 256, 258, 260, 262 and 264, respectively. An idler pulley 266, which is mounted on vertical shaft 268 is provided to properly position the belt to hold the passing envelopes tightly against a window which is located in a plate 269.

A reader device 270 is mounted on the frame of the machine adjacent to the window in face plate 269. The reader device is operable to read sorting information imprinted on the envelopes. The reader device is a conventional type of apparatus and may comprise a magnetic (or optical) reading device having its read head located at the window in plate 269.

Figure 8:
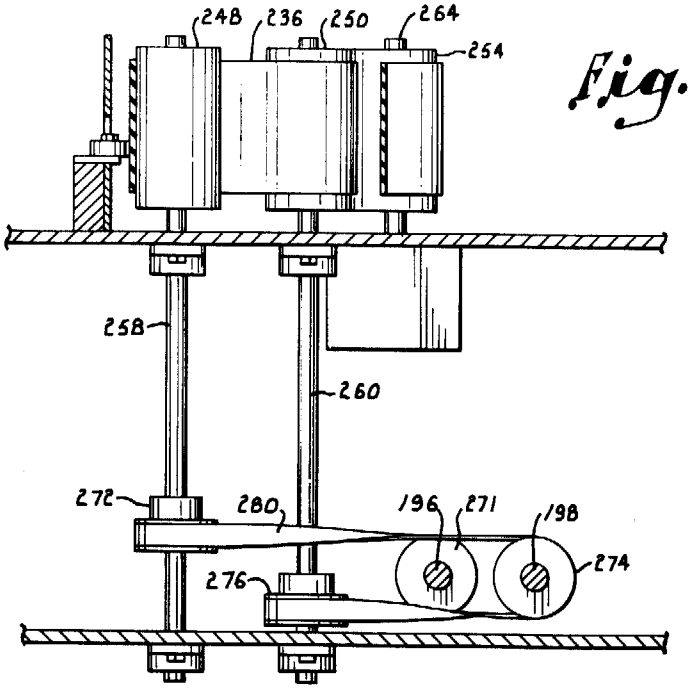
FIG. 8 is a fragmentary sectional view on an enlarged scale taken along line 8—8 of FIG. 3 in the direction of the arrows.

As shown in greater detail in FIG. 8, belt 236 is driven off of shaft 196 by means of a pulley 271 which is mounted on this shaft, a pulley 272 which is mounted on shaft 258, a pulley 274 which is mounted on idler shaft 198, a pulley 276 which is rotatably mounted on shaft 260 by a bushing (not shown) and a belt 280 which is tightly drawn around these pulleys in a continuous loop to impart rotational movement to shafts 258 and 260. In particular, pulley 271 is arranged to simultaneously power drive shaft 258 in a clockwise direction (as viewed in FIG. 3) and shaft 260 in a counterclockwise direction by means of flat belt 236 (as viewed in FIG. 3). Pulley 271 receives belt 280 which is twisted and passed around pulley 272. The belt is twisted again and passed around the idler pulley 274 which is carried on idler shaft 198. From idler pulley 274, the belt is twisted another time and passed around pulley 276 before being twisted a final time and passed back to pulley 271. Since pulley 248 is fixedly secured to drive shaft 258 and pulley 250 is fixedly secured to shaft 260, the rotational movement imparted to each of these shafts is in turn transferred to its associated pulley. The rotation of these pulleys in turn drives belt 236 so as to convey the envelopes through the read station from left to right as viewed in FIG. 3.

A photosensor 271*a* and a light source 273 are located near the end of the input section of the mail sorting machine. The photosensor and its associated light source are positioned and orientated such that an envelope moving toward the storage section of the machine intercepts the light beam projecting between them. This photosensor is used by the machine's control circuitry to monitor the progress of the envelopes and to inform the control circuitry that an envelope is approaching the first set of sorting bins.

Reference is now made to FIGS. 3, 10, 11 and 12 for a more detailed description of the diverter mechanism 24 which is associated with each sorting bin. Each diverter mechanism includes a deflection gate 282, the position of which is controlled by a solenoid 284 through a shaft 285. The deflection gates are equipped with an upper arm 286 and a lower arm 288 which protrude outward from a central body portion 290 to form a generally U-shaped structure. As viewed in FIG. 3, the width of each arm is of a generally triangular configuration with each arm being significantly thinner at its distal end than at the point where it is connected to the central body portion of the gate.

Each diverter mechanism is also provided with a pair of generally rectangularly shaped wheels 292 and 294 which serve to frictionally force a deflected envelope into the sorting bin associated with this diverter mechanism. These rollers are respectively keyed to a common shaft 296 for continuous rotation therewith. Shaft 296 is in turn rotatably secured to the machine support table 297 by means of a bearing block 298.

As shown in FIG. 3, the diverter mechanisms are arranged in pairs on the machine's support table so that a diverter gate of each mechanism cooperates to form a guideway through which the envelopes may be moved in a vertical orientation. The solenoid associated with each deflection gate is operable to move its associated gate through a set arcuate path. In particular, activation of a particular solenoid causes it to move its associated deflection gate into the guideway formed by the diverter mechanisms to direct an advancing envelope into the sorting bin associated with this diverter mechanism. A deflecting gate is shown in position to deflect an advancing envelope in broken lines in FIG. 3. A plurality of pinch rollers 300, 302, 304 and 306 are provided to facilitate movement of the envelopes through the guideway formed by the diverter mechanisms. Rollers 300 and 302 are driven rollers which are mounted on vertical shafts 308 and 310, respectively. Vertical shaft 308 is rotatably coupled with the support table of the machine by means of bearing block 298 while vertical shaft 310 is coupled with the support table of the machine by means of a bearing block 312. Rollers 304 and 306, on the other hand, are idlers which are respectively urged against rollers 308 and 310 and are mounted to the support table by means of support brackets 314 and 316. Each pair of rollers is appropriately spaced apart from one another along the length of the envelopes.

Each diverter mechanism is also provided with a guide plate 318 which aids in directing a deflected envelope into its associated sorting bin. A photosensor 320 and its associated light source 322 are mounted in the back portion of the guide plate to transfer location information to the machine's control circuitry. The photocell and light source are located and oriented such that when an envelope is being conveyed along the guideway between them the light beam is intercepted by the envelope thereby providing to the control circuitry an indication of the presence of an envelope at this point.

The various drive components of each diverter mechanism are powered by a single electric motor 324 through horizontal drive shaft 326. The electric motor is mounted to the underside of the machine's support table by means of a support bracket 328 and has a pulley 330 mounted on its drive shaft 332. This pulley is used to drive a pulley 334 on horizontal shaft 326 through a belt drive 336. The horizontal shaft 336 is rotatably mounted to the machine by means of a plurality of flanged bearings such as 338. Horizontal shaft 336 carries a plurality of pulleys 340 which are spaced apart along the length of the shaft at locations corresponding to each pair of diverter mechanisms. Pulley 340 operates in conjunction with a plurality of pulleys 342, 344, 346, 348, 350 and 352, an idler pulley 354, and a plurality of belts 356, 358 and 360 to power the drive components of each pair of diverter mechanisms corresponding in position to this pulley. In particular, the rotatable movement of shaft 326 is imparted directly to the vertical shaft 296 associated with the set of rectangular rollers which are positioned rearwardly of the guideway formed by the diverter mechanisms and to the shaft 308 of the drive roller 300 by means of pulleys 340, 342, 344, and 354 and belt 356. Pulley 340 receives belt 356 which is twisted and passed around pulley 344. The belt is twisted again and passed around the vertical idler pulley 354 before being twisted once again and drawn around pulley 342. The belt is twisted a final time before passing back around pulley 340. Each vertical shaft 296 located forwardly of the guideway formed by the diverter mechanism carries a pulley 350 which receives a belt 358 driven by a pulley 346 which is mounted on shaft 308. Shaft 310 is similarly driven by means of a belt 360 which passes around a pulley 352 mounted on shaft 310 and a pulley 348 mounted on shaft 308. In this way, the drive components of each diverter mechanism are driven continuously in the proper direction by means of the drive motor 324.

Figure 9:
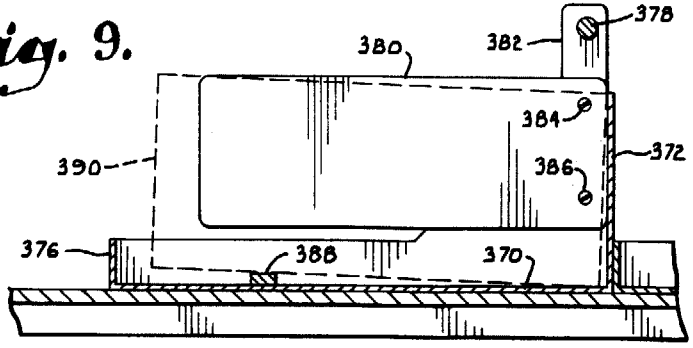
FIG. 9 is a fragmentary sectional view on an enlarged scale taken along line 9—9 of FIG. 3 in the direction of the arrows.

Referring now to FIGS. 3 and 9, the sorting bins are arranged in two rows which extend outward from the machine's support table in a direction which is perpendicular to the guideway formed by the diverter mechanisms. Each sorting bin is constructed to have a flat generally rectangular floor 370, a side retaining wall 372 which is higher than the envelopes to be sorted and an end wall 374 which is located along the distal end of the bin. The sorting bin also includes a short side wall 376 which runs along the other lateral edge of the bin. A shaft 378 is secured to the end wall of the bin and is positioned to run the entire length of the bin at a set distance above the floor thereof. The sorting bin is also equipped with a bias plate 380 which acts on the stored envelopes to keep them in a neat stack. The bias plate is positioned for slidable movement along shaft 378. As shown in FIG. 9, this plate is slidably mounted on the shaft by means of a mounting bracket 382 which is secured to the plate by means of nut and bolt assemblies 384 and 386.

A rectangular rib 388 is attached to the floor of the sorting bin. This rid is positioned closer to the bins sort side wall 376 than to its side retaining wall 372 and is used to hold the envelopes within the bin in an offset position. The position of such an envelope is shown in FIG. 9 in broken lines at 390. As shown in FIG. 9, the envelope is positioned so that only the lower right hand corner of the envelope rests on the floor and the upper right hand corner of the envelope rests against the side retaining wall 372. In this position, the inherent vibratory motion of the machine acts on the stored envelopes to align them along the side retaining wall.

While the control circuitry used in the device may take many different forms, it should be operable to automatically read a sort code imprinted on each envelope, to monitor the movement of an envelope through the sorting device and to control activation of the various solenoids to position a selected deflector gate so as to direct an advancing envelope into its designated sorting bin. Since the control circuitry does not form an integral part of this invention, it has not been described in great detail herein. However, a system suitable for use with the mail sorting machine of the present invention is given and described in the U.S. patent to Holmes U.S. Pat. No. 3,574,328, issued Apr. 13, 1971 and is entitled "Document Transport System", which is incorporated by reference herein.

In operation, a quantity of envelopes 44 is deposited on the magazine 16 in the manner shown in FIG. 1. The envelopes are arranged against one another in vertical planes with their long bottom edges resting on the top surface of the magazine and their front surfaces facing forward toward the feed station. Each envelope has a sort code imprinted on it in an identical location. The sort code serves to indicate the sorting bin into which the envelope is to be deposited. The sorting mechanism is then programmed to match the various sort codes with the sorting bins of the machine. For example, if each envelope with a particular sort code is to be deposited in a particular sort bin the machine's control circuitry is so programmed.

Once the envelopes have been deposited on the magazine, carriage 48 is placed against the trailing envelope and is driven forward by belts 50, 52 and 54 whenever switch mechanism 142 detects the absence of an envelope in position at the feed station. As the carriage forces the stack of envelopes forward to the feed station, the leading envelope is brought in contact with contact arms 144 and 146 of switch 142. Thereafter, continued forward movement of the stack by the carriage causes the lead envelope to move one or both of the contact arms to an "off" position thereby placing switch 142 in an "off" condition. Placement of switch 142 in an "off" condition in turn causes motor 56 to be shut off. Once a sufficient number of envelopes have been picked off the front of the stack by the feed station, the contact arms of switch 142 return to the "on" position thereby returning the switch mechanism to an "on" condition. The motor responds to this "on" condition by being energized and driving the stack of envelopes forward towards the feed station. In this way, motor 56 runs intermittently to maintain a supply of envelopes at the feed station but is shut off before belts 50, 52 and 54 have a chance to wear a hole in the bottom edge of the envelopes while they are being held stationary at the feed station.

Suction device 72 operates in combination with conveying belts 68 and 70 to effectively separate the leading envelope from the rest of the envelopes of the stack and to convey this envelope away from the feed station to the other equipment of the sorting machine. Conveying belts 68 and 70 are continuously rotated in unison about suction box 76 in a counter clockwise direction when viewed in FIG. 3. As each grouping of holes in these belts moves in front of its corresponding suction opening in the face plate 79 of suction box 76, the low pressure maintained in this box by suction pump 74 acts through these holes to draw the leading envelope toward the friction surface of the belts for conveyance away from the stack. Conveyance belts 68 and 70 completely cover their corresponding suction openings 80 and 82 thereby preventing the suction effect created within the box from acting on the leading envelope unless a grouping of holes is positioned between the leading envelope and the suction openings of the box. In this way, the leading envelope is drawn against the conveying belts for movement away from the feed station only when one of the groupings of holes in each conveying belt is positioned between the suction opening and the leading envelope. By concentrating the suction force to such a small area, vacuum bleed through is virtually eliminated thereby facilitating separation of the envelopes by reducing the tendency of the suction device to simultaneously draw two envelopes toward the conveying belts.

In the preferred embodiment of the invention, each conveying belt is provided with two groupings of holes which are positioned at diametrically opposite points of the belts. It should be noted that the frequency at which the envelopes are separated may be varied by changing the number of groupings of holes in the belt, changing the length of the belts, and/or varying the speed at which the belts are driven.

Jogger arms 110 and 112 aid in separating the envelopes. In particular, these arms serve to push the whole stack of envelopes back away from the friction surface of the conveying belts just before a grouping of holes on each belt is interposed between its corresponding suction opening and the leading envelope. Movement of the entire stack in this manner frees the leading envelope for easier separation of this envelope from the remaining stack in a more efficient manner.

The conveying belts are not only used to separate and convey envelopes away from the feed station but also to impart rotational movement to shaft 100 through pulleys 92 and 104. This rotational movement is then transferred from shaft 100 to shaft 124 through pulleys 208 and 210 by belt drive 212. As shaft 124 rotates, belt crank arm 120 causes pivot bar 116 to continuously pivot about its pivot point due to the eccentric manner in which the belt crank arm is coupled to the shaft. The pivotal movement of the pivot bar in turn causes the jogger arms to oscillate between a retracted position wherein the arms sit within grooves in the face plate 79 behind the friction surface of the conveying belt and an extended position wherein the arms protrude outward from the conveying belts to thereby force the entire stack of envelopes back away from the friction surface of the belts. Through proper selection of pulleys 208 and 210, the operation of the jogger arms is synchronized with the movement of the conveying belts so that the jogger arms are operable to move the stack of envelopes back away from the conveying belts just before a grouping of holes approaches the suction openings in the box.

Solenoid 134 operates in conjunction with the jogger arms 110 and 112 to provide an automatic shut off which is capable of interrupting separation of the envelopes at the feed station. This solenoid is capable of retaining locking pin 138 in a raised position when it is activated. Deactivation of this solenoid, however, causes the locking pin to drop behind the upper jogger arm 110 next time this arm is moved to its extended position. Placement of the locking pin behind the upper jogger arm prevents this arm from returning to a retracted position. As described above, the jogger arms are biased by coil spring 132 in a pushing position from which they are capable of limited pivotal movement in a forward direction. When the locking pin is in place behind the jogger arms, the arms are prevented from returning to a retracted position thereby causing the arms to remain in an extended position wherein they hold the envelopes away from the friction surface of the conveying belts to prevent further separation and conveyance of the envelopes away from the feed station.

The separated envelopes are conveyed from the feed station to the read station in a vertical orientation by means of friction rollers 148, 150, 152, 154, 156 and 158. As the envelope moves to the read station from the feed station, it passes between photosensors 178 and 180 thereby producing an electrical signal which is sensed by the control circuitry to monitor the movement of the envelope and to alert the reading device of an approaching envelope.

The envelopes are then moved past the reading device by means of a belt 236 which operates in combination with idler rollers 238, 240, 242 and 244. An idler roller 266 is provided to hold the envelope flat as it moves past a window in face plate 269 to facilitate reading of the sort code imprinted on the envelope. The reading device is located adjacent to this window so that its read head is aligned with the sort code imprinted on the envelope. As the envelope passes by the window, the reading device reads the sort code and then transfers this code to the machine's control circuitry which temporarily stores the code for future reference. The envelope is then transferred to the storage section of the machine where it is deposited in the designated sorting bin.

The envelope passes between photosensor 271 and light source 273 on its way to the storage section of the device. This photosensor is used to monitor the progress of the envelope and to indicate to the control circuitry than an envelope is approaching the pair of diverter mechanisms associated with the first set of sorting bins. The control circuitry responds to this signal by comparing the sort code associated with this envelope with the code assigned to the first set of sorting bins. If the sort code does not coincide with the code assigned to either of these sorting bins, the envelope passes through the guideway formed by the first pair of diverting mechanisms unimpeded. Movement of the envelope through the guideway formed by these diverting mechanisms causes it to interrupt the beam of light projected between photosensors 320 and 322 thereby indicating to the control circuitry that this envelope is approaching the second pair of diverter mechanisms. The control circuitry responds to this signal by once again comparing the sort code associated with this envelope with the codes assigned to the second set of sorting bins. The envelope continues to move through the sort section of the machine until the control circuitry locates its proper sorting bin.

When the control circuitry determines that the envelope is approaching its designated sorting bin, an activation signal is sent to the solenoid associated with this bin from the control circuitry. The solenoid responds to the signal by causing its attendant deflector gate to move from its normal position to the deflect position shown in broken lines in FIG. 3. In this position, a deflector gate interrupts the normal movement of the envelope through the guideway formed by the diverter mechanisms and directs the envelope into the sorting bin associated with this gate. The deflected envelope is driven into this sorting bin by means of the rectangularly shaped rollers 292 and 294. These rollers are constructed to have a generally rectangular shape so that they are not constantly in contact with the flat surface of the stored envelopes. In this way, these rollers are less likely to wear a hole in the envelopes stored in each sorting bin. To further reduce the tendency of these rollers to wear a hole in the stored envelopes, these rollers are constructed of a material having a low coefficient of friction with respect to paper.

The envelopes are directed into and stored within the sorting bins in a vertical plane. The envelopes are driven into these sorting bins such that the leading edge of the envelope comes in contact with the side retaining wall and such that the lower edge of the envelope rests on the rectangular rib which runs along the floor of the bin. In this way, the envelopes are stored in the bins in an off set position wherein only the upper right hand corner of the envelope (when viewed in FIG. 9) and the lower right hand corner of the envelope (when viewed in FIG. 9) contact the side retaining wall and floor of the bin, respectively. In this position, the inherent vibratory motion of the machine causes the envelopes to line up against the side retaining wall thereby providing a neat stack wherein all of the envelopes are conveniently aligned. The biasing plate 380 keeps the envelopes in a vertical position. In particular, this plate is initially positioned as close to its associated diverter mechanism as possible. Thereafter, the incoming envelopes cooperate to force this plate away from its associated diverter mechanism. This plate, however, is mounted to resist movement away from its diverter mechanism to thereby keep the envelopes in a vertical orientation.

From the foregoing, it will be seen that this invention is one well adapted to attain all ends and objects hereinabove set forth together with the other advantages which are obvious and which are inherent to the structure.

It will be understood that certain features and subcombinations are a utility and may be employed without reference to other features and subcombinations.

As many possible embodiments may be made of the invention with out departing from the scope thereof, it is to be understood that all matter herein set forth or shown in the accompanying drawings is to be interpreted as illustrative and not in a limiting sense.

Having thus described the invention, I claim:

1. A mail sorting apparatus for sorting envelopes and the like, said apparatus comprising:

a structural frame presenting a magazine thereon, said magazine being adapted to receive a plurality of envelopes to be sorted;

means for advancing said envelopes to be sorted in conjunction with said magazine to deliver the leading envelope to an envelope feed station;

at least one conveying belt supported for movement on said frame in proximity to said envelope feed station, said conveying belt presenting a friction surface capable of engaging the leading envelope so that movement of said conveying belt is operable to convey said leading envelope away from said envelope feed station;

power means for moving said conveying belt;

means for moving the leading envelope against the friction surface of said conveying belt to convey the leading envelope away from said envelope feed station;

at least one storage bin adapted to receive a plurality of sorted envelopes;

a transport guideway for conveying said envelopes to said storage bin from said envelope feed station in a substantially vertical orientation, a diverter means associated with said storage bin for diverting an envelope from said transport guideway into said storage bin, said storage bin being comprised of a generally rectangular floor;

a side retaining wall integrally formed with said floor and protruding upward therefrom;

a bias plate slidably mounted to said storage bin for movement relative to said floor and said side retaining wall, said bias plate being arranged to maintain the envelopes stored in this bin in a vertical plane; and a raised rib protruding upward from the floor of said storage bin to hold envelopes stored in this bin against said floor and side retaining wall in an offset position.

2. A mail sorting machine for sorting envelopes and the like, said apparatus, comprising a structural frame presenting a magazine thereon, said magazine being adapted to receive a plurality of envelopes to be sorted;

means for advancing the envelopes to be sorted along said magazine to deliver the leading envelope to an envelope feed station;

at least one conveying belt supported for movement on said frame in proximity to said envelope feed station, said conveying belt presenting a friction surface which is capable of engaging the leading envelope so that movement of said conveying belt is operable to convey said leading envelope from said envelope feed station;

power means for moving said conveying belt;

suction means for drawing the leading envelope against the friction surface of said conveying belt to convey the leading envelope away from said envelope feed station;

a plurality of storage bins on said frame, each bin being adapted to receive a plurality of sorted envelopes;

a transport guideway formed by a plurality of diverter means which are arranged in pairs to provide a channel through which envelopes may be conveyed in a vertical plane, each of said diverter means being operable to direct an envelope from said transport guideway into an associated storage bin, each of said storage bins being comprised of a generally rectangular floor;

a side retaining wall adjacent to said floor;

moveable means mounted mounted relative to said bin floor and arranged to maintain the envelopes stored each in a vertical plane; and a raised rib protruding upward from the floor of said storage bin to hold envelopes stored therein against said floor and side retaining wall in an offset position.

3. A mail sorting apparatus for sorting envelopes and the like, said apparatus comprising:

a structural frame presenting a magazine thereon, said magazine being adapted to receive a plurality of envelopes to be sorted;

means for advancing said envelopes to be sorted along said magazine to deliver the leading envelope to an envelope feed station;

at least one conveying belt supported for movement on said frame in proximity to said envelope feed station, said conveying belt presenting a friction surface which is capable of engaging the leading envelope so that movement of said conveying belt is operable to convey said leading envelope away from said envelope feed station;

power means for moving said conveying belt;

suction means for drawing the leading envelope against the friction surface of said conveying belt to convey the leading envelope away from said envelope feed station;

a plurality of storage bins on said frame, each bin being adapted to receive a plurality of sorted envelopes;

each of said storage bins having a generally rectangular floor;

a side retaining wall integrally formed with said floor and protruding upward therefrom;

a bias plate slidably mounted to said storage bin for movement relative to said floor and said side retaining wall, said bias plate being rearranged to maintain the envelopes stored in this bin in a vertical plane;

a raised rib protruding upward from the floor of said storage bin to hold envelopes stored in this bin against said floor and side retaining wall in an offset position;

a transport guideway for conveying envelopes to said storage bins from said envelope feed station in a substantially vertical orientation; and a diverter means associated with each storage bin for directing an envelope from said transport guideway into an associated storage bin.

4. In a mail sorting apparatus of the type operable to sort a plurality of envelopes in accordance with an indicator thereon, the improvement therein of a storage bin comprising a floor surface;

a side retaining wall located adjacent to said floor surface and extending upwardly therefrom;

a movable means mounted relative to said floor for assisting in maintaining the envelopes stored in said bin in a preselected plane; and a raised rib protruding upwardly from said floor surface in said storage bin and operable to orient said envelopes in said bin in an offset position so that simultaneous full edge contact with both the bin floor and the retaining wall is precluded.

* * * * *